US008177141B2

(12) United States Patent
Hagaman

(10) Patent No.: US 8,177,141 B2
(45) Date of Patent: May 15, 2012

(54) LAMINAR DECK JET

(75) Inventor: John T. Hagaman, West Hills, CA (US)

(73) Assignee: Zodiac Pool Systems, Inc., Vista, CA (US)

( * ) Notice: Subject to any disclaimer, the term of this patent is extended or adjusted under 35 U.S.C. 154(b) by 206 days.

(21) Appl. No.: 12/340,520

(22) Filed: Dec. 19, 2008

(65) Prior Publication Data

US 2010/0155497 A1 Jun. 24, 2010

(51) Int. Cl.

| | |
|---|---|
| ***B05B 17/08*** | (2006.01) |
| ***B05B 15/06*** | (2006.01) |
| ***B05B 1/26*** | (2006.01) |
| ***B05B 1/02*** | (2006.01) |

(52) U.S. Cl. ..... 239/18; 239/17; 239/201; 239/211; 239/420; 239/433; 239/543

(58) Field of Classification Search ..... 239/12, 239/16–18, 20–23, 69, 200, 201, 211, 276, 239/282, 283, 285, 288–288.5, 398, 418, 239/420, 426, 433, 434, 543–545, 548, 562, 239/565, 580; 362/96, 318

See application file for complete search history.

(56) References Cited

U.S. PATENT DOCUMENTS

| | | | | |
|---|---|---|---|---|
| 766,165 | A | 8/1904 | Beitten | |
| 895,668 | A | 8/1908 | Newman | |
| 1,184,827 | A | 5/1916 | Coto-Ston | |
| 1,198,303 | A | 9/1916 | Williams | |
| 1,504,851 | A | 8/1924 | Wren | |
| 1,624,081 | A * | 4/1927 | Taylor | 239/12 |
| 1,804,001 | A | 5/1931 | Eck | |
| 2,051,382 | A | 8/1936 | King | |
| 2,147,925 | A | 2/1939 | Schwalbe | |
| 2,364,848 | A | 12/1944 | Hurst | |
| 2,642,813 | A | 2/1950 | Woodruff et al. | |
| 2,499,966 | A | 3/1950 | Neely | |
| 3,022,016 | A | 2/1962 | Shrewsbury | |
| 3,088,675 | A | 5/1963 | Bone | |
| 3,385,526 | A | 5/1968 | Furrer | |

(Continued)

FOREIGN PATENT DOCUMENTS

| | | |
|---|---|---|
| DE | 2641802 | 3/1978 |

(Continued)

OTHER PUBLICATIONS

Jandy 2007 Pool and Spa Products Catalog, Water Features, pp. 155-178, plus Introduction and Table of Contents (4 pages), Jandy Pool Products, Inc.

(Continued)

*Primary Examiner* — Darren W Gorman
(74) *Attorney, Agent, or Firm* — Dorsey & Whitney LLP

(57) ABSTRACT

Methods and apparatuses are disclosed for fluid handling devices with enhanced functionality. In some embodiments, the fluid handling device may include a plurality of filters coupled to the fluid handling device, where passing a first stream of fluid through the plurality of filters may improve the laminarity of the first stream of fluid, an orifice situated about the fluid handling device, where the first stream of fluid may exit the fluid handling device through the orifice in a substantially laminar state, and a surface disruptor coupled to the fluid handling device, where the surface disruptor may provide a second stream of fluid and where the disruptor may be positioned such that the second stream of fluid interferes with the first stream of fluid exiting the fluid handling device.

11 Claims, 18 Drawing Sheets

U.S. PATENT DOCUMENTS 3,690,554 A 9/1972 Hruby, Jr.
3,705,686 A 12/1972 Hruby, Jr.
3,730,439 A 5/1973 Parkison
3,730,440 A 5/1973 Parkison
3,782,629 A 1/1974 Hruby, Jr.
3,785,559 A 1/1974 Hruby, Jr.
3,820,716 A 6/1974 Bauer
3,851,825 A 12/1974 Parkison et al.
3,858,620 A 1/1975 Hruby, Jr.
3,949,213 A 4/1976 Paitchell
4,002,293 A * 1/1977 Simmons ..... 239/11
4,119,276 A 10/1978 Nelson
4,269,352 A 5/1981 Przystawik
4,334,328 A 6/1982 Delepine
4,443,899 A 4/1984 Johnson
4,502,304 A 3/1985 Hopkins
4,503,563 A 3/1985 Johnson
4,520,514 A 6/1985 Johnson
4,593,420 A 6/1986 Tobias et al.
4,689,827 A 8/1987 Gurney, Jr.
4,730,786 A 3/1988 Nelson
4,742,965 A 5/1988 Messinger et al.
4,750,993 A 6/1988 Donhauser et al.
4,795,092 A 1/1989 Fuller
4,877,084 A 10/1989 Goggin
4,881,280 A 11/1989 Lesikar
4,912,782 A 4/1990 Robbins
4,941,217 A 7/1990 Tobias et al.
4,955,540 A 9/1990 Fuller et al.
4,982,460 A 1/1991 Tobias et al.
4,983,517 A 1/1991 Kim et al.
4,985,943 A 1/1991 Tobias et al.
5,078,320 A 1/1992 Fuller et al.
5,095,558 A 3/1992 Howard
5,115,973 A * 5/1992 Fuller et al. ..... 239/20
5,115,974 A 5/1992 Tobias et al.
5,127,111 A 7/1992 Sieth
5,169,065 A 12/1992 Bloch
5,207,499 A 5/1993 Vajda et al.
5,231,865 A 8/1993 McDermott et al.
5,242,119 A 9/1993 Jariyasunant
5,271,561 A 12/1993 Tobias et al.
5,309,581 A 5/1994 Lockwood et al.
5,431,342 A 7/1995 Saripalli et al.
5,432,688 A 7/1995 Tobias et al.
5,537,696 A 7/1996 Chartier
5,607,224 A 3/1997 Tobias et al.
5,658,723 A 8/1997 Oberhardt
5,738,280 A 4/1998 Ruthenberg
5,884,871 A 3/1999 Fedorov et al.
5,893,179 A 4/1999 Johnson
6,196,471 B1 3/2001 Ruthenberg
6,209,586 B1 4/2001 Wright
6,250,570 B1 6/2001 Starr et al.
6,322,004 B1 11/2001 Perdreau et al.
6,340,035 B2 1/2002 Wright
6,379,025 B1 4/2002 Mateescu et al.
6,393,771 B1 5/2002 Stetson
6,431,170 B1 8/2002 Truitt et al.
6,439,472 B1 8/2002 Lin et al.
6,470,509 B1 10/2002 Ayeni
6,471,146 B1 10/2002 Kuykendal et al.
6,484,953 B2 11/2002 Freier
6,491,238 B1 12/2002 Swanson et al.
6,557,588 B2 5/2003 Wright
6,565,011 B1 5/2003 Kuykendal et al.
6,611,114 B1 8/2003 Yen
6,641,056 B2 11/2003 Kuykendal et al.
6,676,031 B2 1/2004 Kuykendal et al.
6,691,336 B2 2/2004 Buck
6,798,154 B1 9/2004 Sullivan et al.
6,805,458 B2 10/2004 Schindler et al.
6,811,286 B2 11/2004 Mateescu et al.
6,857,746 B2 2/2005 Dyner
6,973,681 B2 12/2005 Ayeni et al.
7,012,384 B2 3/2006 Tatewaki et al.
7,023,147 B2 4/2006 Colby et al.
7,055,988 B2 6/2006 Mateescu et al.
7,097,329 B2 8/2006 Mateescu et al.
7,125,146 B2 10/2006 Willis et al.
7,128,440 B2 10/2006 Mateescu et al.
7,188,378 B2 3/2007 Ryan
7,204,602 B2 4/2007 Archer
7,214,029 B2 5/2007 Richter
7,264,176 B2 9/2007 Johnson
7,293,300 B2 11/2007 Kunkel
7,316,359 B2 1/2008 Beidokhti
7,381,129 B2 6/2008 Avedon
7,404,649 B2 7/2008 Gosis et al.
7,514,884 B2 4/2009 Potucek et al.
2002/0088869 A1 7/2002 Simmons
2003/0010836 A1 1/2003 Pham
2004/0129794 A1 7/2004 Deichmann
2006/0002104 A1 1/2006 Willis et al.
2006/0092636 A1 5/2006 Potucek et al.
2006/0102757 A1 5/2006 Johnson
2006/0163374 A1 7/2006 Wooten
2006/0175423 A1 8/2006 White et al.
2006/0175424 A1 8/2006 Tatum et al.
2006/0291213 A1 12/2006 Mateescu et al.
2007/0159833 A1 7/2007 Netzel, Sr. et al.
2008/0128027 A1 6/2008 Hyde et al.
2008/0128560 A1 6/2008 Hyde et al.
2008/0128561 A1 6/2008 Hyde et al.
2010/0155498 A1 6/2010 Hagaman

FOREIGN PATENT DOCUMENTS

EP 275084 7/1988

OTHER PUBLICATIONS

Jandy 2008 Pool and Spa Products Catalog, Water Features, pp. 173-194, plus Introduction and Table of Contents (5 pages), Jandy Pool Products, Inc.

Jandy AquaLink™ RS One Touch™ Control Systems, Owner's Manual, known at least as early as Dec. 19, 2008, 60 pages.

Jandy Laminar Jet Part #JLJ1001, Laminar Jet Reference Guide, known at least as early as Dec. 19, 2008, 1 page.

Jandy Laminar Jets & Deck Jets, Sell Sheet, 2006, 2 pages.

Jandy™ Laminar Jet with Deck Box, Installation and Operation Manual, known at least as early as Dec. 19, 2008, 12 pages, Moorpark, California.

Jandy™ WaterColors LED, Underwater Large and Small Light, Installation Manual, 2008, 20 pages, Moorpark, California.

MagicStream™ Laminar Installation and User's Guide, Pentair Water Pool and Spa, Inc., 2008, Sanford, NC and Moorpark, CA, 20 pages.

Pour-A-Lid Masonry Deck Products Home Page and Products Page, accessed at www.pouralid.com on Aug. 27, 2010 (known at least as early as Mar. 3, 2008), 2 pages.

Zodiac 2009 Product Catalog, Water Features, pp. 81-110, plus Introduction and Table of Contents (9 pages), Zodiac Pool Systems, Inc.

Zodiac 2010 Product Catalog, Water Features, pp. 197-226, plus Introduction and Table of Contents (5 pages), Zodiac Pool Systems, Inc.

* cited by examiner

LAMINAR DECK JET

TECHNICAL FIELD

The present invention relates generally to water handling devices for pools and spas, and more particularly to water handling devices for pools and spas with enhanced mechanical, lighting, and/or flow features.

BACKGROUND

Water handling devices may be used in a variety of settings. For example, water handling devices may be used in decorative displays that range from residential pools in a homeowner's backyard to commercial water displays of the type seen in amusement parks. Some of these decorative displays may include jets that project water supplied from a body of water back into the body of water or into a secondary body of water. In order to contribute to the overall aesthetic appeal of the decorative display, these jets may be implemented beneath grade and/or out of the sight of an observer viewing the decorative display. Because the jets may be employed beneath grade, however, they may be particularly difficult to construct and/or maintain. For example, some jets may be housed beneath grade and covered with a lid that allows the water from the jet to escape through an aperture in the lid. In these embodiments, the jet may be suspended from the lid itself, which may make it difficult to adjust and maintain the jet.

Visual affects achieved using these jets may vary based upon the type of jet used. For example, some of these jets, termed herein as "laminar jets", may project substantially laminar water flow back into the body of water. To add to the overall aesthetic appeal, some embodiments may couple sources of light into this laminar water flow. Unfortunately, because of the smooth surface of the laminar water flow and the straight columnar segments of the water flow, light coupled into the laminar water flow may be difficult to see.

Accordingly, there is a need for water handling devices with enhanced features that solve one or more of the foregoing problems.

SUMMARY

Methods and apparatuses are disclosed for fluid handling devices with enhanced functionality. In some embodiments, the fluid handling device may include a plurality of filters coupled to the fluid handling device, where passing a first stream of fluid through the plurality of filters may improve the laminarity of the first stream of fluid, an orifice situated about the fluid handling device, where the first stream of fluid may exit the fluid handling device through the orifice in a substantially laminar state, and a surface disrupter coupled to the fluid handling device, where the surface disruptor may provide a second stream of fluid and where the disruptor may be positioned such that the second stream of fluid interferes with the first stream of fluid exiting the fluid handling device.

Other embodiments may include a fluid handling device including a canister, a collar coupled to the canister, a lid coupled to the collar, and a laminar jet situated within the canister, wherein the laminar jet may be suspended from the collar.

Other embodiments may include a method of operating a water handling device, the method including passing a first stream of fluid through a plurality of filters in the water handling device, ejecting the first stream of fluid from the water handling device, where the first stream may be in a substantially laminar state, and disrupting the substantially laminar state of the first stream of fluid using a second stream of fluid.

Still other embodiments may include a fluid handling device, including a canister, the canister including an exit orifice and a first adjustment valve, a first stream of fluid exiting the fluid handling device through the exit orifice in a substantially laminar state, and a disrupter coupled to the canister, where the disruptor emits a second stream of fluid configured to intersect with the first stream, where the second stream modifies the substantially laminar state of the first stream, and where the first adjustment valve is capable of modifying a flow rate of the first stream.

BRIEF DESCRIPTION OF THE DRAWINGS

The use of the same reference numerals in different drawings indicates similar or identical items.

DETAILED DESCRIPTION OF THE INVENTION

Although one or more of these embodiments may be described in detail, the embodiments disclosed should not be interpreted or otherwise used as limiting the scope of the disclosure, including the claims. Further, to the extent that certain implementations are disclosed as "exemplary", it should be understood that these are merely representations of possible implementations rather than the only possible implementation. Also, although the terms "fluid" and "water" may be used interchangeably herein, it should be appreciated that this disclosure applies to devices operating on all types of fluids and not just water. In addition, one skilled in the art will understand that the following description has broad application. Accordingly, the discussion of any embodiment is meant only to be exemplary and is not intended to intimate that the scope of the disclosure, including the claims, is limited to these embodiments.

Embodiments are disclosed that may allow for improved laminar jet operations and/or functionality. In some embodiments, the laminar jet may be mounted to a collar of a housing rather than the lid of the housing. By mounting the laminar jet to a collar of the housing rather the lid of the housing the laminar jet may be more easily removed from the housing. Other embodiments may include one or more mechanisms for adjusting the flow rate of the laminar jet without having to remove the laminar jet from its housing. In still other embodiments, the laminar jet may include light emitting diodes (LEDs) that may be synchronized to other laminar jets so as to operate in concert as a synchronized system. Further still, some embodiments may include a surface disruptor that may perturb laminar flow coming out of the laminar jet, and thereby, may enhance lighting that is coupled with the laminar flow.

Figure 1A:
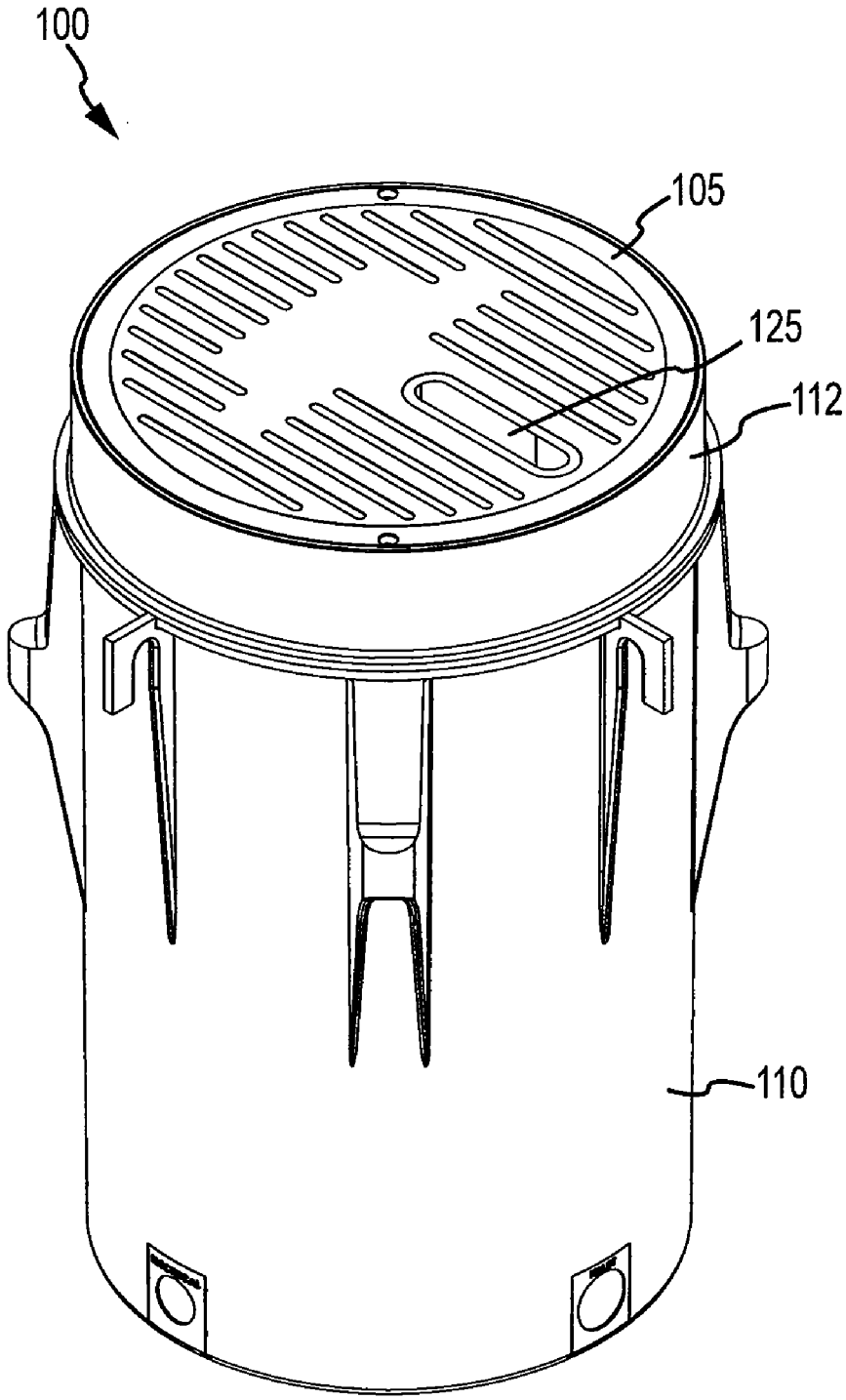
FIG. 1A illustrates an exemplary housing.

FIG. 1A illustrates an exemplary housing 100. The housing 100 may include a lid 105 coupled to a canister 110 via a collar 112. Embodiments of the lid 105 may include lids where the top is a vacant cavity that is filled with aggregate to match a surrounding grade, such as the POUR-A-LID® manufactured by Stetson Development, Inc.

Figure 1B:
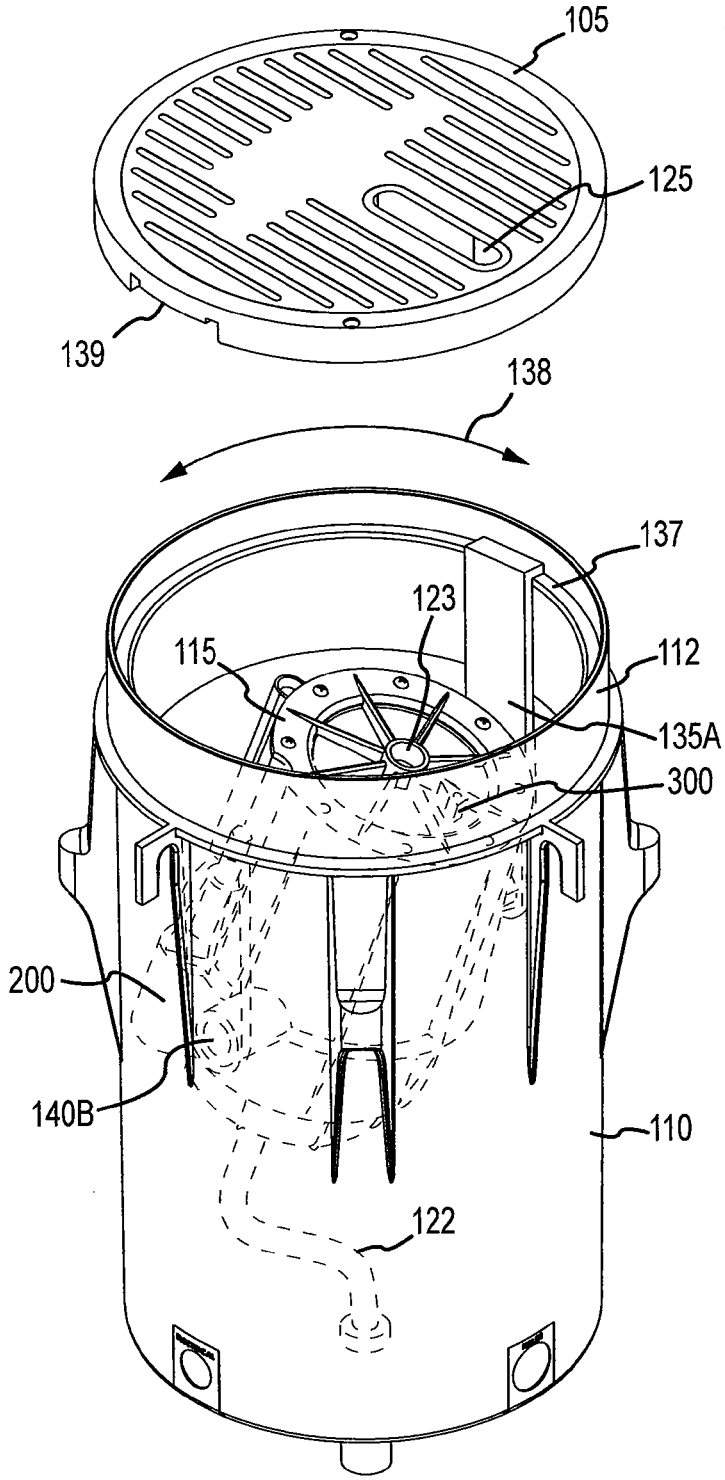
FIG. 1B illustrates an exemplary water handling device in phantom within the exemplary housing.

The housing 100 also may contain a variety of water handling devices. FIG. 1B illustrates a laminar jet 115 in phantom as but one of the many such water handling devices that may be implemented in the housing 100. For the sake of discussion, this disclosure will focus on embodiments employing the laminar jet 115, however, it should be appreciated that the principles disclosed herein apply to a wide variety of water handling devices.

Figure 1C:
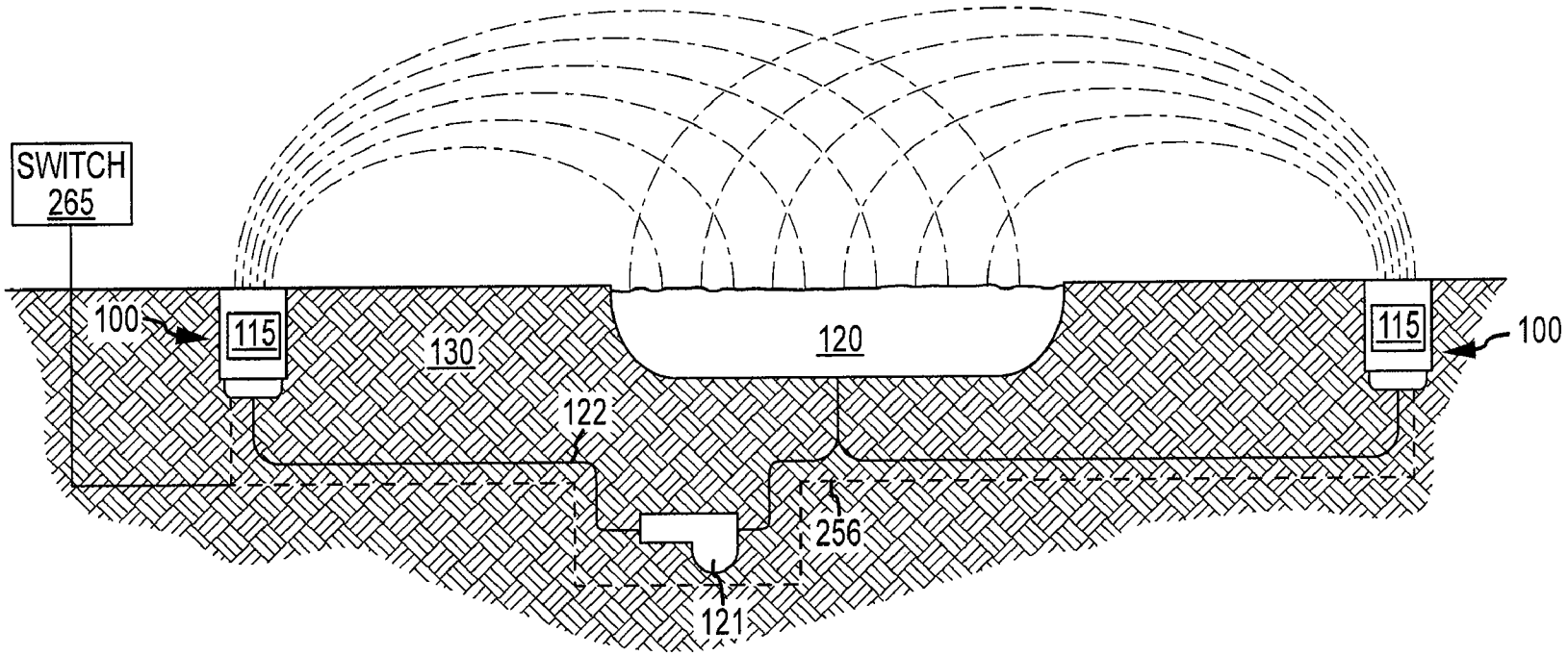
FIG. 1C illustrates the exemplary water handling device situated about a body of water.

Regardless of the particular water handling device implemented, the housing 100 may be situated about a body of water 120 as shown in the FIG. 1C. Although two housings 100 and/or water handling devices are shown situated about the body of water 120, it should be appreciated that a variety of numbers of housings 100 and/or water handling devices are possible. During operation, water may be drawn from the body of water 120 via a water supply line 122. Water from the supply line 122 may be drawn into the laminar jet 115 (situated within the housing 100 shown in FIG. 1C) where it is then projected through an orifice 123 in the laminar jet 115 (shown in FIG. 1B) and out of the housing 100 via an opening 125 in the lid 105 (shown in FIG. 1B). In some embodiments, water from the supply line 122 is drawn from the body of water 120 using a pump 121 that is separate from the laminar jet 115. Thus, in some embodiments, the water in the supply line 122 may be pressurized prior to entering the laminar jet 115. In other embodiments, the laminar jet 115 may be integrated with a pump that draws water from the body of water 120 through the supply line 122 and into the laminar jet 115.

Depending upon the configuration of the water handling device and/or the lid 105, the water exiting the opening 125 may follow a variety of adjustable trajectories as shown in FIG. 1C. As shown in the exemplary embodiment of FIG. 1C, the top surface or lid of the housing 100 may be positioned in a cavity in a deck 130 surrounding the canister 110 and the collar 112. In this manner, the housing 100 may be substantially flush with the surface of the deck 130 and allow it to be concealed during operation. In addition, by implementing the top of the housing 100 substantially level with the deck 130, the top of the lid 105 may be flush with the deck 130 and reduce the risk of tripping on the housing 100 and also contribute to the overall aesthetic appeal of the housing-lid configuration.

Figure 1D:
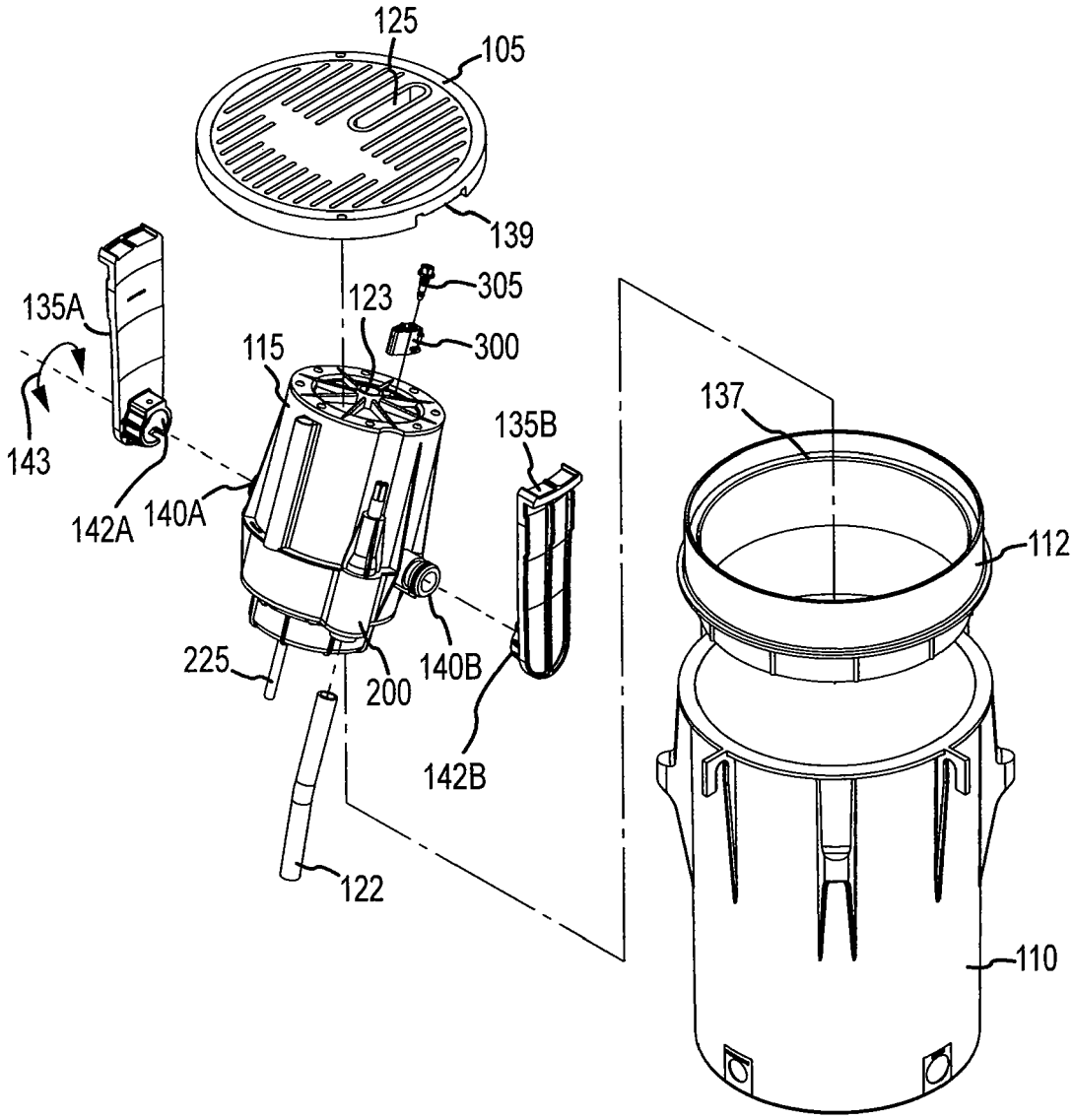
FIG. 1D illustrates an exploded view of the exemplary water handling device and the housing.
Figure 1E:
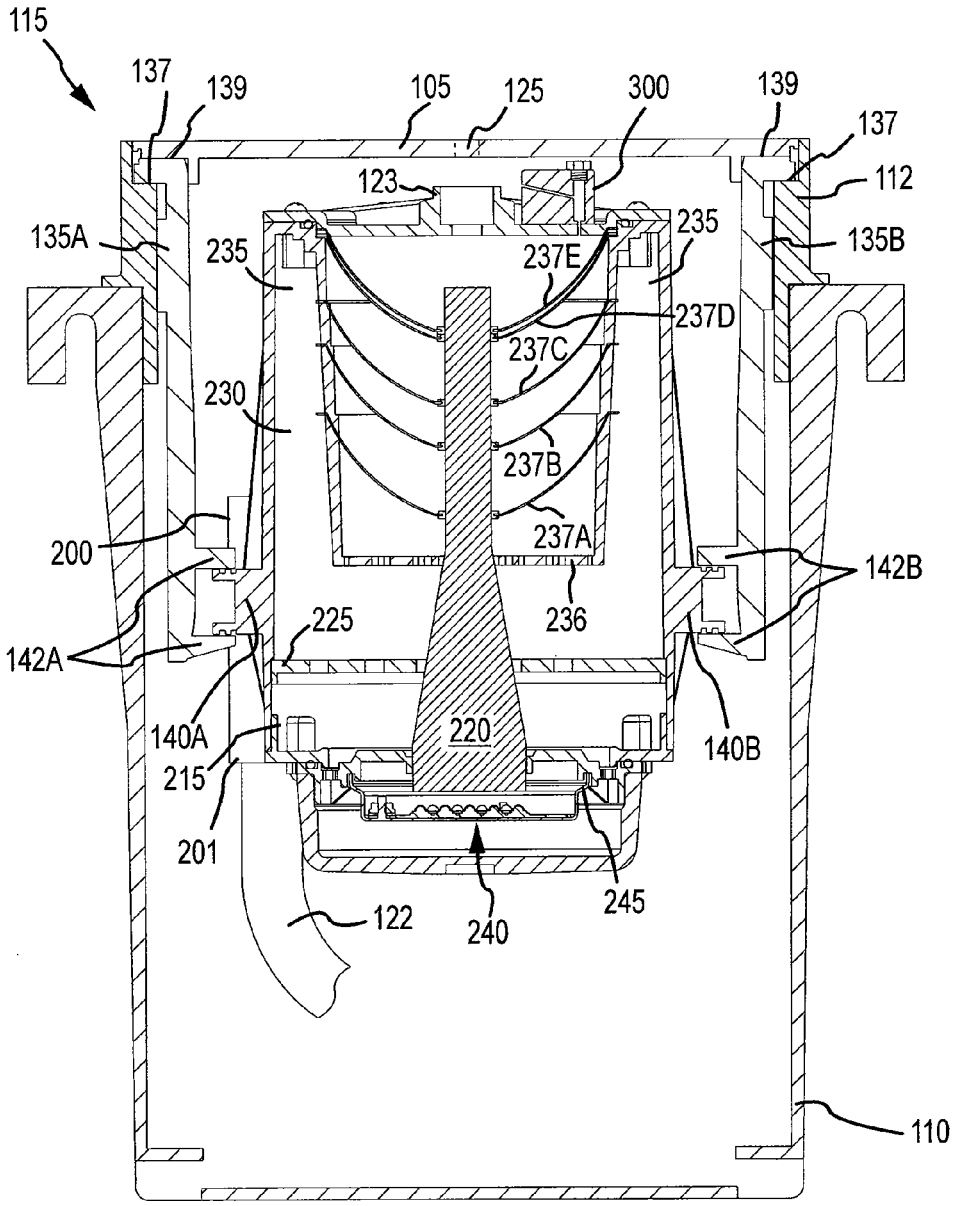
FIG. 1E illustrates a cross sectional view of the exemplary water handling device within the housing.

FIG. 1D illustrates an exploded view of the laminar jet 115 and the housing 100. FIG. 1E illustrates a cross section of the laminar jet 115 within the housing 100. Referring to FIGS. 1D and 1E in conjunction with FIG. 1B, the laminar jet 115 may be situated within the housing 100 and hang from the collar 112 using two or more adjustable hanging brackets 135A-B. In some embodiments, the collar 112 and the adjustable brackets 135A-B may be a single unitary piece such that only a single bracket may be used. The brackets 135A-B may seat on an inner lip 137 of the collar 112 such that the laminar jet 115 may swivel about the collar 112 as indicated by the double sided arrow 138 in FIG. 1B. This may allow a wide variety of trajectories in the body of water 120.

To accommodate the brackets 135A-B, and to allow the laminar jet 115 to sit flush to the top of the collar 112, the lid 105 may include a plurality of recesses 139 situated about the surface of the lid 115 that engages the collar 112. Suspending the laminar jet 115 from the collar 112, instead of from the lid 105, may allow the laminar jet 115 to be more modular, which may allow for ease of installation and adjustment. For example, if the laminar jet 115 were hung from the lid 105, the cumbersome combined lid-jet structure would have to be removed and then the laminar jet 115 may need to be unfastened from the lid 105 in order to adjust the laminar jet 115.

As shown in FIGS. 1D and 1E, the brackets 135A-B may couple to the laminar jet 115 using a series of stubs 140A-B that rotatably seat within respective cavities 142A-B. Some embodiments may secure the stubs 140A-B to the cavities 142A-B using a press fit connection. Other embodiments may implement the stubs 140A-B in a threaded fashion such that the stubs 140A-B screw into the cavities 142A-B. In this manner, the laminar jet 115 may be centered within the housing 100 by threading and/or unthreading the stubs 140A-B into and/or out of the cavities 142A-B. During operation, the stubs 140A-B may rotate within the cavities 142A-B allowing the laminar jet 115 to move in the direction shown by the double sided arrow 143 in FIG. 1D. Moving the laminar jet 115 in this fashion may allow fluid exiting the laminar jet 115 via the orifice 123 to accomplish the varying trajectories shown in FIG. 1C.

Figure 1F:
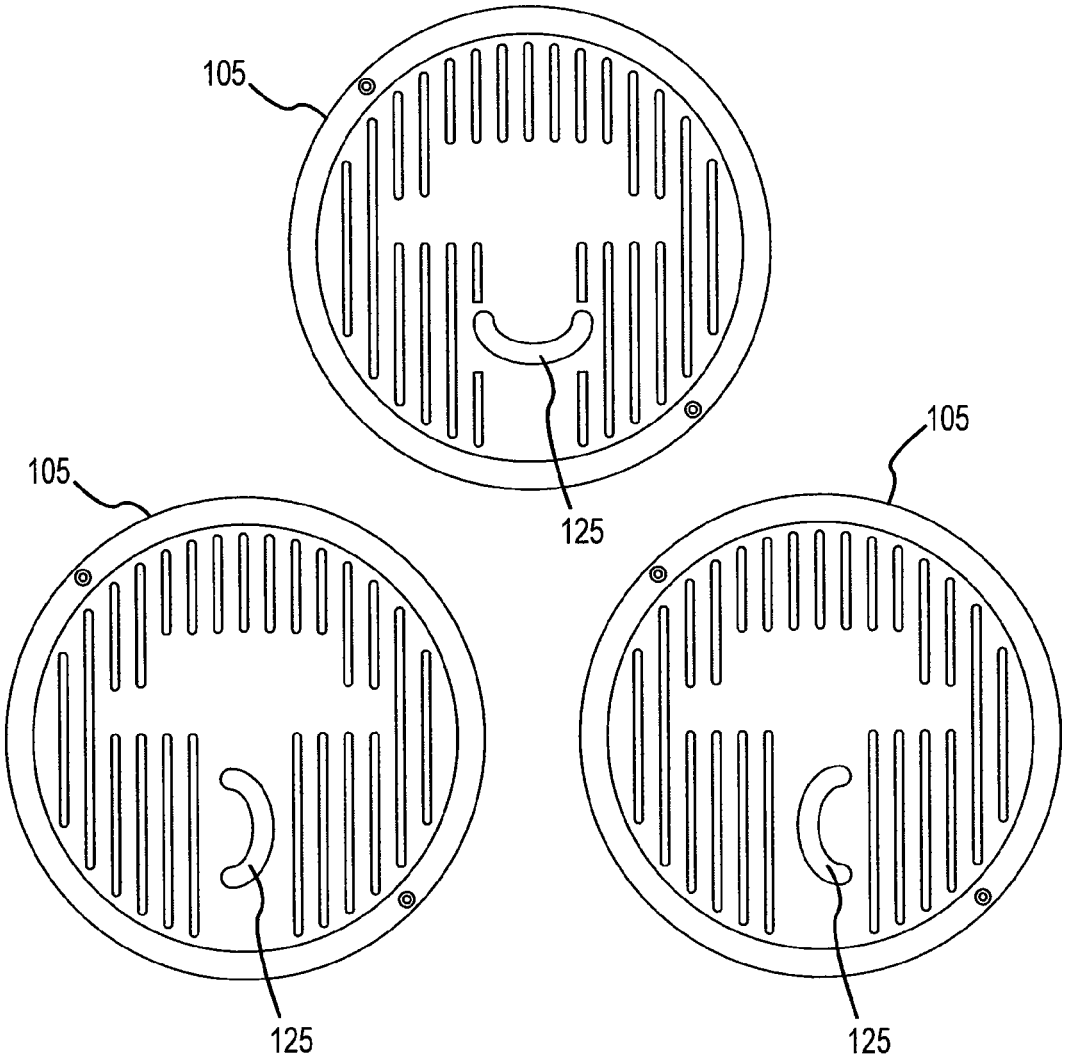
FIG. 1F illustrates alternate lid configurations.

The opening 125 also may be configured to allow for varying trajectories. For example, the opening 125 may be an elongated loop as shown in FIGS. 1A, 1B, and 1D. Other embodiments, such as those shown in FIG. 1F, may include arcuate openings 125 having a curved path with respect to the surface of the lid 105 such that the water from the orifice 123 may be adjusted along this curved path by adjusting the laminar jet 115 within the housing 110.

Figure 2A:
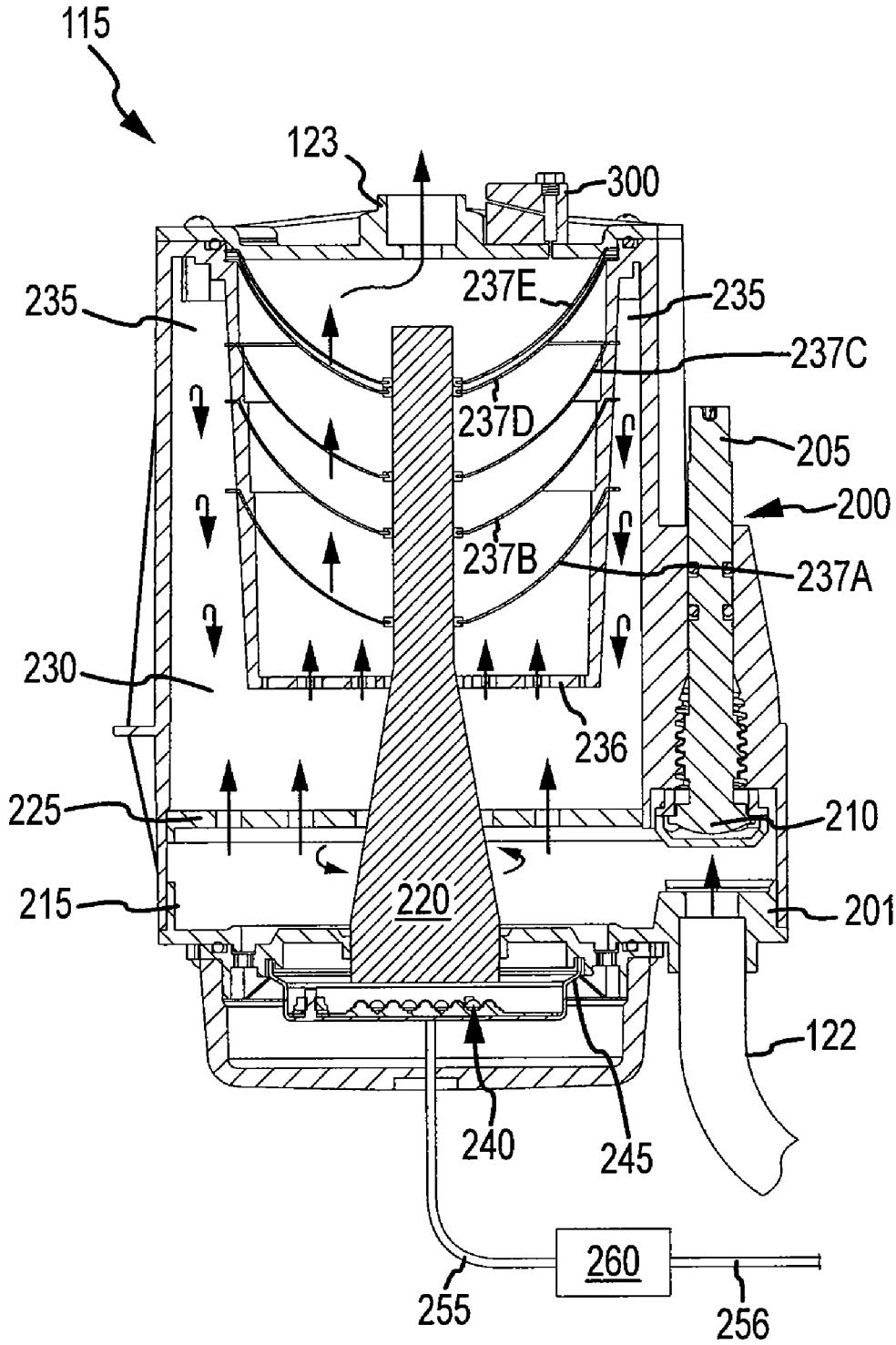
FIG. 2A illustrates a cross sectional view of an exemplary water handling device.
Figure 2B:
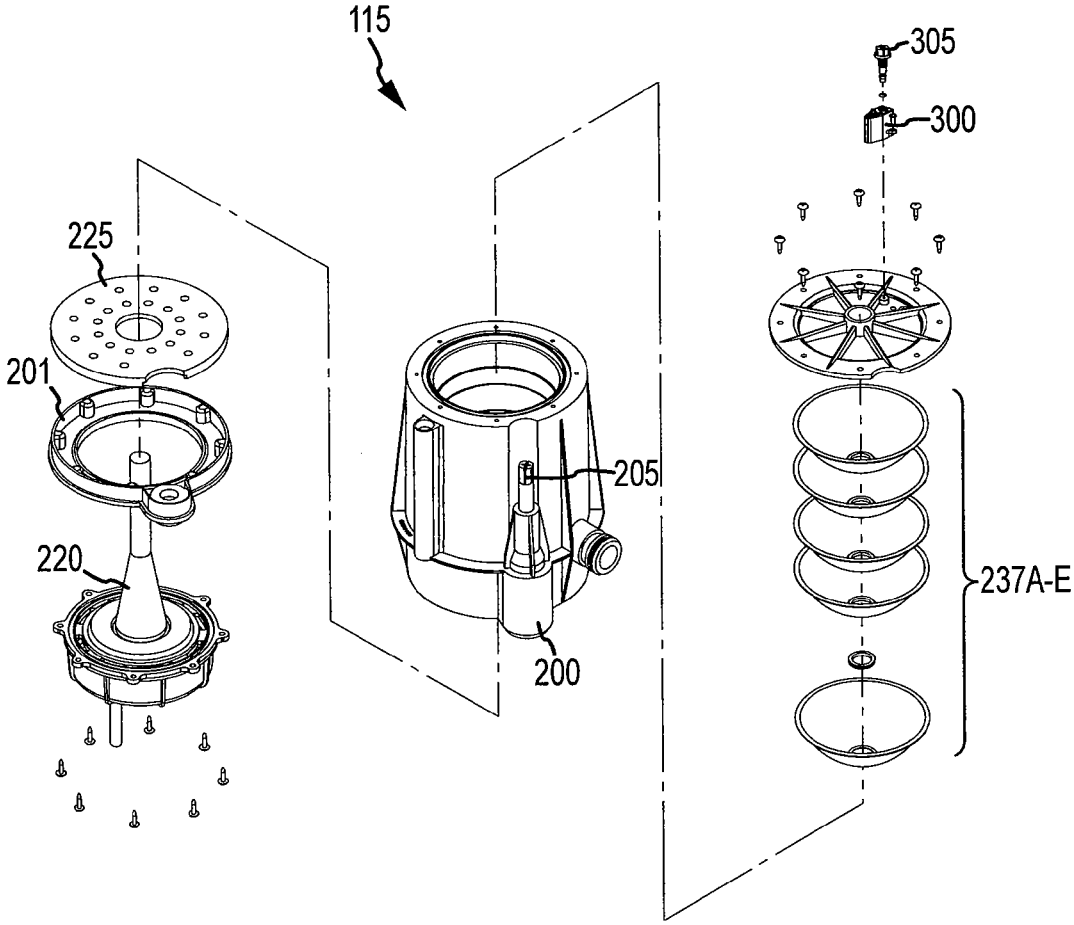
FIG. 2B illustrates an exploded view of the exemplary water handling device.
Figure 2C:
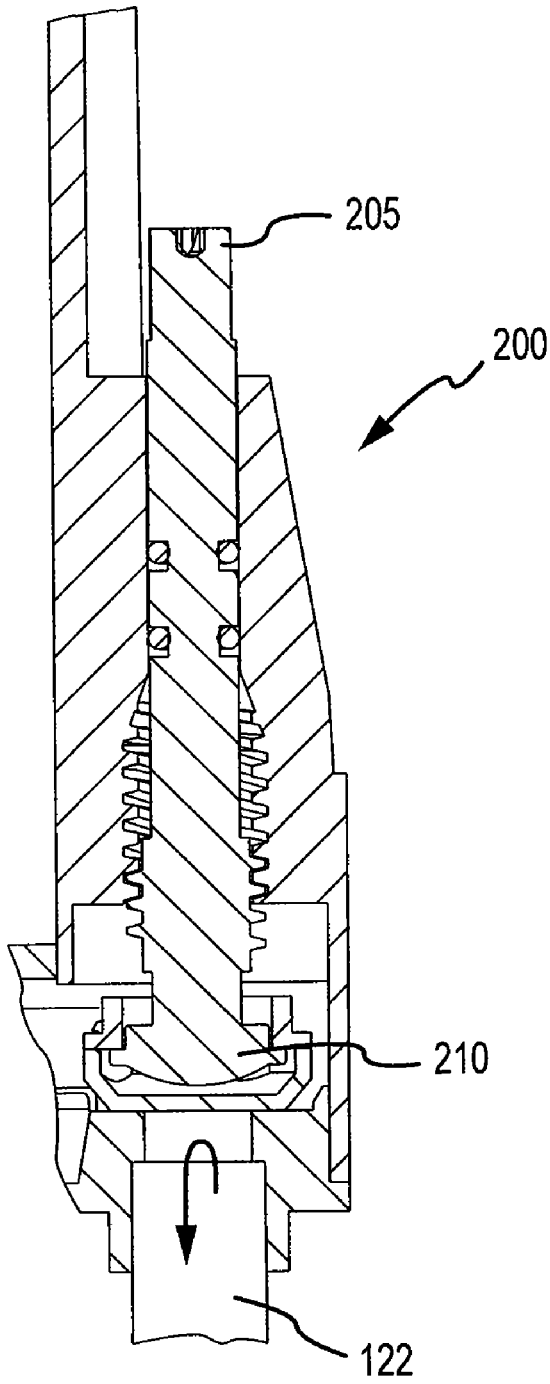
FIG. 2C illustrates a cross sectional view of an exemplary valve in the closed position.
Figure 2D:
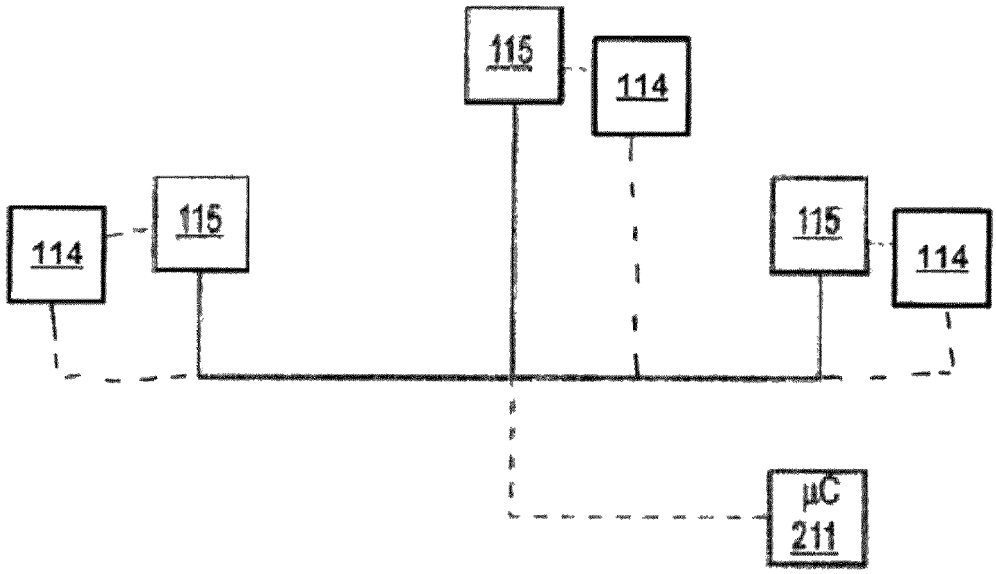
FIG. 2D illustrates a block diagram of an exemplary control network of water handling devices.

FIG. 2A illustrates a cross sectional view of the exemplary implementation of the laminar jet 115. FIG. 2B illustrates an exploded view of the exemplary implementation of the laminar jet 115. Referring to FIGS. 2A-B, the laminar jet 115 may include a flow adjustment valve 200 coupled to a lower bracket 201 of the laminar jet's 115 housing. The embodiment shown in FIGS. 2A-B utilizes a screw 205 that may be rotated clockwise and/or counter clockwise to control the overall volumetric flow rate of fluid entering the bracket 201, and thereby also may control the overall volumetric flow rate of fluid through the laminar jet 115. As shown by the directional arrows in FIG. 2A, during operation, water entering the bracket 201 may flow past a piston 210 coupled to the screw 205. In this manner, as the screw 205 is rotated, the overall flow rate through the laminar jet 115 may be varied. For example, FIG. 2C shows the piston 210 fully seated against the supply line 122 such that fluid does not enter the laminar jet 115.

Although the embodiment shown in FIG. 2 illustrates the use of a screw 205, it should be appreciated that many alternate arrangements are possible. For example, the valve 200 may employ a hand actuated controller, such as a thumbscrew or T-handled valve, to adjust the flow rate. Still other embodiments may utilize an electrically controlled servo, solenoid, stepper motor, and/or worm gear to adjust the flow rate. This adjustment may be controlled individually or in a networked fashion using a logic controller 211 as shown in FIG. 2D. For example, the logic controller 211 may couple to a plurality of servos 114 on the laminar jets 115 to synchronize their flow operations with each other. In some embodiments, the logic controller 211 may be implemented using a microcontroller, such as the PIC32™ from Microchip.

When the laminar jet 115 is positioned within the housing 100, as shown in FIGS. 1B and 1C, the volumetric flow rate may be adjusted by turning the screw 205. This may allow a user to adjust the flow rate of the laminar jet 115 without having to remove it from the housing 100. In fact, in some embodiments, the lid 105 may include an opening (not shown) that aligns with the screw 205 so that the screw 205 may be adjusted without removing the lid 105. Adjusting the flow rate in conjunction with adjusting the angle of the laminar jet 115 with respect to the housing may allow various trajectories.

Water flow through the laminar jet 115 may follow a path illustrated by the arrows in FIG. 2A. Referring to FIG. 2B in conjunction with the arrows shown in FIG. 2A, water may flow into a receiving chamber 215 where it may circulate about a light tube 220 (described in further detail below). Pressure from the supply line 122 may force the water from the receiving chamber through a baffle 225 into an intermediate chamber 230. In general, turbulent flow may exist when streamlines of the fluid intersect and cross each other creating a mixture of fluid in the flow path. As water passes through the baffle 225 the turbulence of the flow path may be reduced. Water exiting the baffle 225 may circulate within the intermediate chamber 230. The intermediate chamber 230 may contain an annular cavity 235 that surrounds the laminar jet 115 such that water entering the intermediate chamber 230 may travel within the annular cavity 235 before exiting the intermediate chamber 230. The water's turbulence also may be reduced by traveling through the annular cavity 235 prior to exiting the intermediate chamber 230. As shown in the embodiment depicted in FIG. 2A, the annular cavity 235 may be manufactured as a rigid plastic structure.

Water may exit the intermediate chamber 230 and pass through a second baffle 236 further calming the flow, and then through a plurality of conically shaped mesh filters 237A-E. As water flows through each successive stage of the filers 237A-E, the laminarity of the water flow may be improved until the water flow exiting the laminar jet 115 is substantially laminar in form—i.e., streamlines of fluid are substantially parallel. In this manner, the water exiting the laminar jet 115 may produce a laminar arc of water into the body of water. These laminar arcs of water may be used in a variety of settings for decorative purposes, such as decorative water fountains and/or light displays around bodies of water.

Each of the filters 237A-E may include an opening for the light tube 220 to pass through. Some embodiments may use a fiber optic material for the light tube 220. In other embodiments, the light tube 220 may be a clear or colored plastic or other suitable material.

As shown in FIG. 2A, the light tube 220 may couple to a plurality of lights 240. During operation, the light tube 220 may impart photon energy it receives from the lights 240 onto the laminar water flow exiting the orifice 123. Exemplary implementations of the lights 240 may include halogen, incandescent, digital light processing (DLP), and LEDs to name but a few. In the embodiments utilizing LEDs, the laminar jet's 115 housing may be smaller than other lighting types. Also, since the LEDs may be implemented as an array as shown, implementing the lights 240 using LEDs may add a level of redundancy such that if one of the LEDs fail, the other LEDs in the array may compensate. This may reduce the overall maintenance of the laminar jet 115. Furthermore, implementing the lights 240 as an array of LEDs may allow different colors of lights to be turned on independent of each other. For example, the lights 240 may include red, green, and blue LEDs where the water flowing out the laminar jet 115 may be made any variety of colors by selectively combining these primary colors.

Figure 2E:
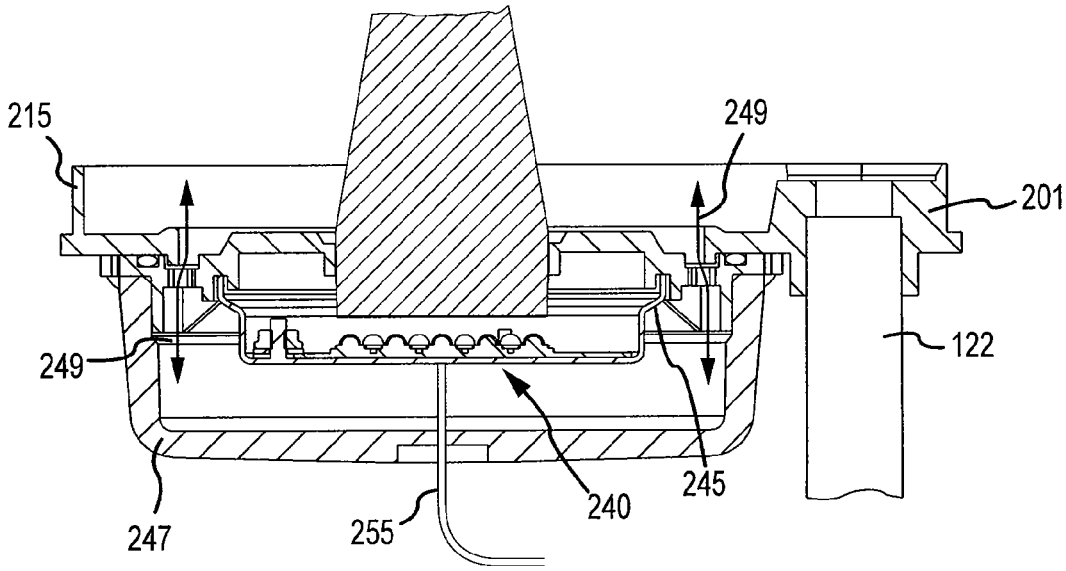
FIG. 2E illustrates a cross sectional view of an exemplary light configuration.

FIG. 2E illustrates an exploded view of the lights 240 situated within the bottom of the laminar jet 115. The lights 240 may reside in a sealed canister 245 that is thermally coupled to the water flowing in the laminar jet 115. Water in the receiving chamber 215 may enter and/or exit a bottom chamber 247 of the laminar jet 115 through a series of slots 249 as shown by the arrows in FIG. 2E. Once in the bottom chamber 247, the water may immerse the canister 245 to cool the lights 240. Because the canister 245 is sealed, water flowing through the laminar jet 115 may be prevented from entering the canister 245 and damaging the lights 240. Some embodiments may implement the canister 245 using thermally conductive metal, such as stainless steel in compliance with the Underwriters Laboratories 676 standard for underwater luminaries and submersible junction boxes. In this manner, the water immersing the canister may cool the lights 240 and reduce the level of thermal stress on the lights 240. The lights 240 may receive their electrical power and/or electrical control signals via an electrical supply line 255. For example, in the embodiments where the lights 240 include multiple colors of lights, the control wires may control which of various colors are lit at different points in time.

Referring back to FIG. 2A, in some embodiments, a main electrical line 256 capable of carrying standard electrical power (e.g., 120 VAC, 60 Hz) may be coupled to a controller 260 located in the housing 100. The controller 260 may be capable of converting the power received from the main electrical line 256 down to a suitable voltage and/or suitable current for the lights 240 and providing it to the laminar jet's 115 electrical supply line 255. Additionally, the controller 260 may be capable of providing one or more electrical control signals to the lights 240 based upon whether an electrical signal is present on the main electrical line 256. For example, as shown in FIG. 1C, there may be multiple laminar jets 115, where the laminar jets 115 are coupled together via the main electrical supply line 256. In some embodiments, the laminar jets 115 may be synchronized via the electrical supply line 256 by switching the electrical power on the supply line 255 on and off using a switch 265. For example, as a user toggles the switch 265 on and off a predetermined number of times, the laminar jets 115 may initialize, and as the switch 265 is further toggled, the laminar jets 115 may be programmed to achieve a predetermined light color or color pattern. In some embodiments, the changes in lighting may be synchronized to music. Furthermore, in some embodiments, the switch 265 may control the flow adjustment valve 200 or a surface disrupter 300 (described in detail below) along with the light color and/or music. This control may be random in some embodiments, or a predetermined pattern in other embodiments.

Light may be coupled from the light tube 220 into the fluid flow prior to exiting the orifice 123. As mentioned previously, the water flow from the laminar jet 115 may be substantially laminar as it exits the orifice 123, and therefore, it may have a smooth glass rod-like outer surface. Because of this glass rod-like outer surface, light coupled into the water may be carried by the exiting water with minimal angular scatter. That is, the water flow may be conducted like a fiber optic light tube such that bends in the water flow path may reflect the light, making the light more prominent at the bends, whereas the straight portions of the water flow path may have a transparent appearance. Since the water flow from the laminar jet 115 may have a transparent appearance in some sections, the laminar jet 115 may include a surface disruptor 300 as shown in the exploded view of FIG. 3A.

Figure 3A:
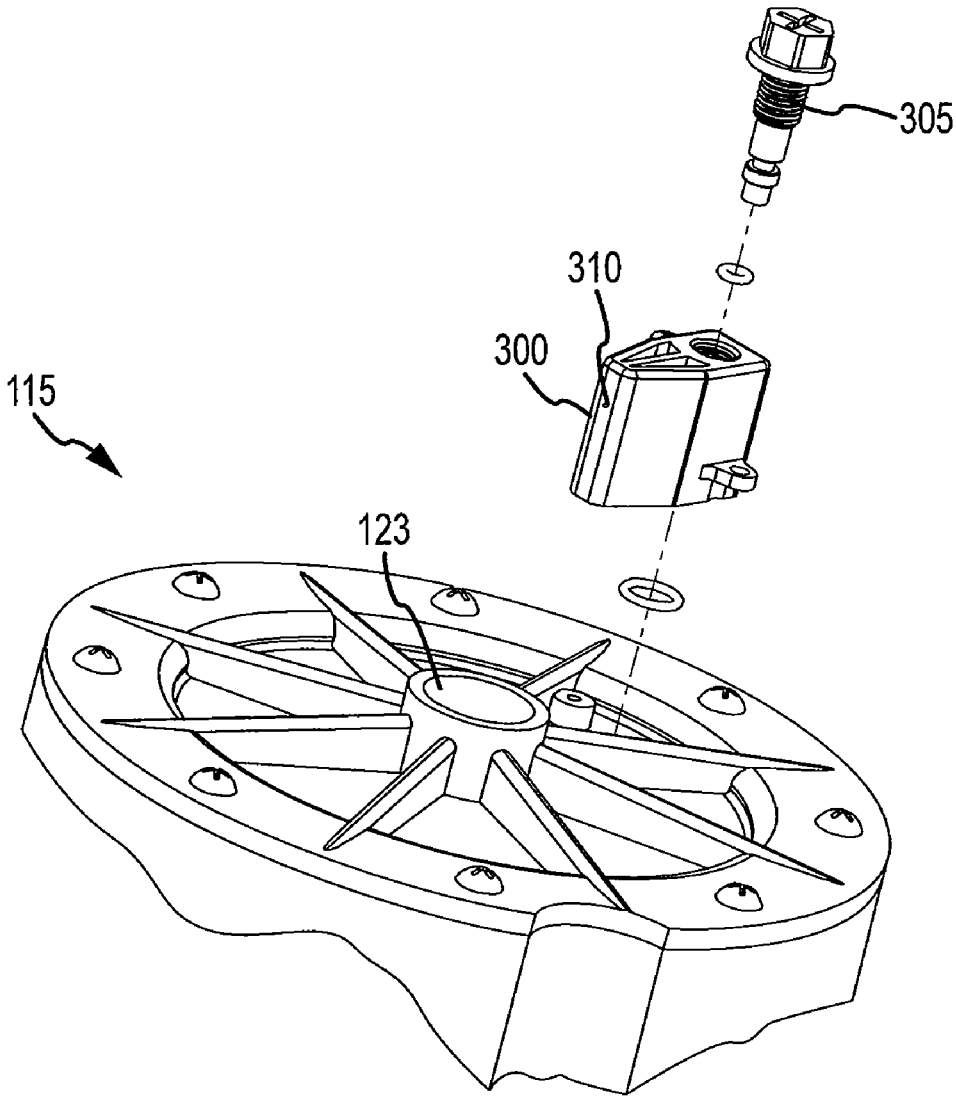
FIG. 3A illustrates an exploded view of an exemplary surface disrupter.

Referring to FIG. 3A, the surface disrupter 300 may couple to the laminar jet 115 near the orifice 123. In some embodiments, the disruptor 300 may be coupled to the laminar jet 115 using a screw 305, while in other embodiments, the disruptor 300 may include one or more tabs (not shown) that press fit into the laminar jet 115 to secure the disruptor 300 to the laminar jet 115. During operation, the surface disruptor 300 may perturb the surface of the laminar flow of water exiting the orifice 123. By disrupting the surface of the laminar flow, light transmission in the water flow may be enhanced. In other words, light in the water flow may be more noticeable because the glass rod-like appearance of the surface of the laminar flow may have deliberate imperfections introduced. Some embodiments may modify the surface of the laminar flow by diverting at least a portion of water from the water circulating in the laminar jet 115 into the water exiting the orifice 123. For example, as shown in FIG. 3B, the disruptor 300 may include an orifice 310 that emits a stream 315 of water from the laminar jet 115 in such a way that that the trajectory of the water emitted from the orifice 310 intersects with a laminar flow 320 coming from the orifice 123.

Figure 3B:
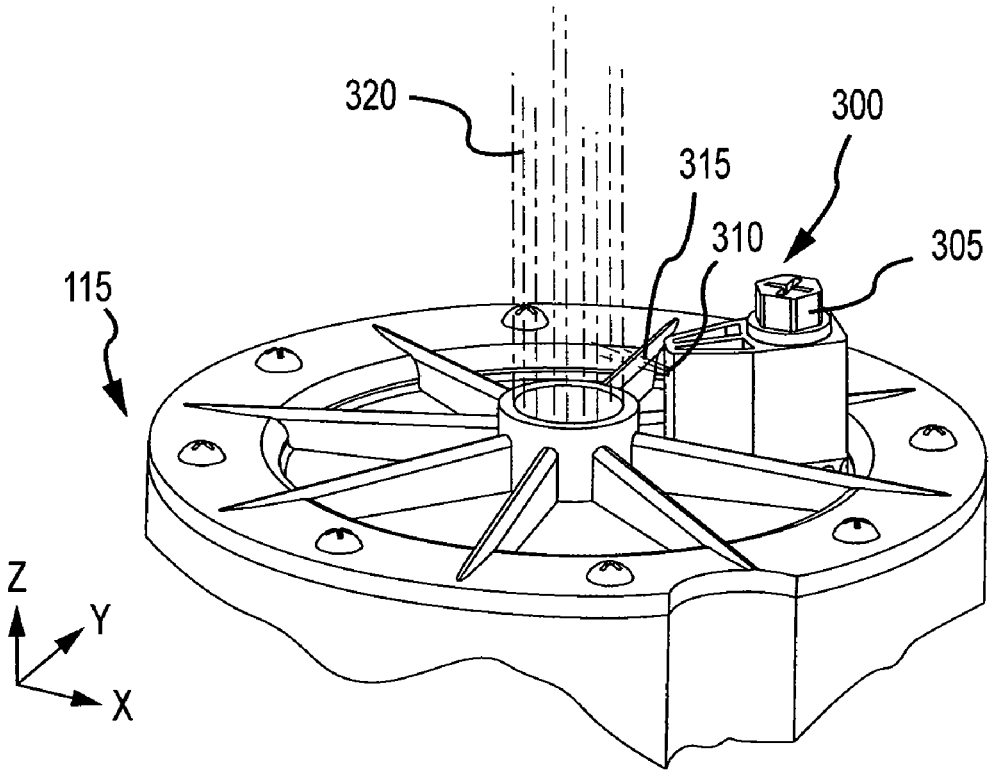
FIG. 3B illustrates the surface disruptor during exemplary operations.
Figure 3C:
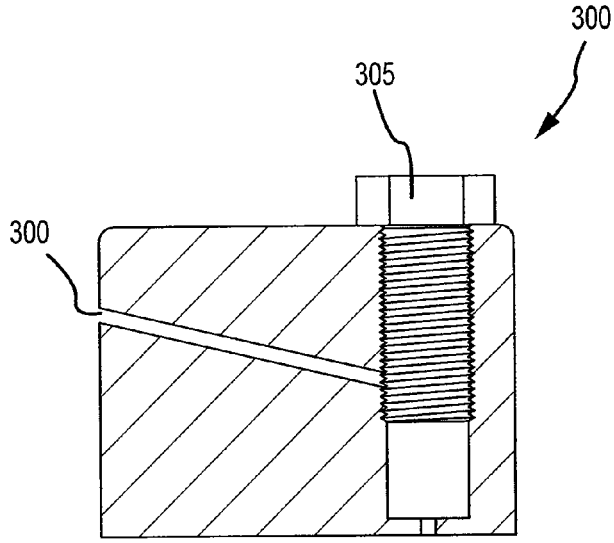
FIG. 3C illustrates a cross sectional view of an exemplary surface disrupter.

FIG. 3C illustrates a cross section of the disruptor 300. As the screw 305 threads in and out of the disruptor 300, the flow rate of the stream 315 exiting the orifice 310 may vary. Adjusting the flow rate of the stream 315 in this manner may modify the laminarity of the laminar flow 320, and therefore, the appearance of light conducted therein. FIGS. 3A and 3B illustrate embodiments where the adjustment mechanism for the flow rate of the stream 315 is a screw that may be adjusted with a screwdriver. In these embodiments, the lid 105 may include an opening (not shown) to insert a screwdriver so that the lid does not need to be removed to adjust the flow rate and/or appearance of the lighting in the laminar flow 320. Other embodiments may include hand actuated valves, such as thumbscrews or a T-valve. Still other embodiments may utilize an electrical servo to adjust the flow rate of the stream 315. These adjustment mechanisms may be controlled by the logic controller 211 shown in FIG. 2D.

Figure 3D:
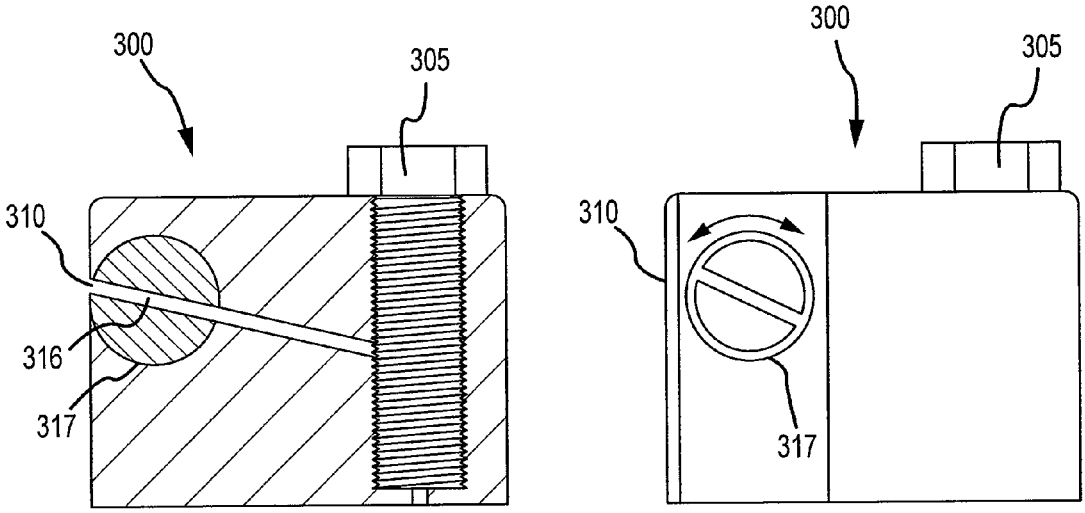
FIG. 3D illustrates an exemplary adjustment mechanism for the surface disruptor.

The angular intersection of the stream 315 and the laminar flow 320 shown in FIG. 3B may be adjusted to modify the lighting effects and/or trajectories of the laminar flow 320. For example, by loosening the screw 305 the disruptor may be adjusted in the plane defined by the surface of the laminar jet 115. Also, as shown in the perspective and cross sectional views in FIG. 3D, in some embodiments, the disruptor 300 may include a flexible exit tube 316 that may be adjusted to adjust the trajectory of the stream 315. As shown, the exit tube 316 may be coupled to a hand actuated valve 317. Rotating this valve may adjust the angular intersection of the stream 315 and the laminar flow 320. While the valve 317 is shown as hand actuated, it should be appreciated that other embodiments may include a variety of hand actuated valves, such as thumbscrews or a T-valve. Still other embodiments may utilize an electrical servo to adjust the angle of the stream 315. These adjustment mechanisms may be controlled by the logic controller 211 shown in FIG. 2D. Thus, the stream 315 may be adjusted along the X, Y, and/or Z axes (shown in FIG. 3B) to vary its angle of intersection with the laminar flow 320.

In some embodiments, the flow rate of the stream 315 may be adjusted in conjunction with the flow rate of the laminar flow 320. For example, screws 305 and 205 may be adjusted together with the valve 317 until a desired appearance for the laminar flow 320 is achieved.

Figure 3E:
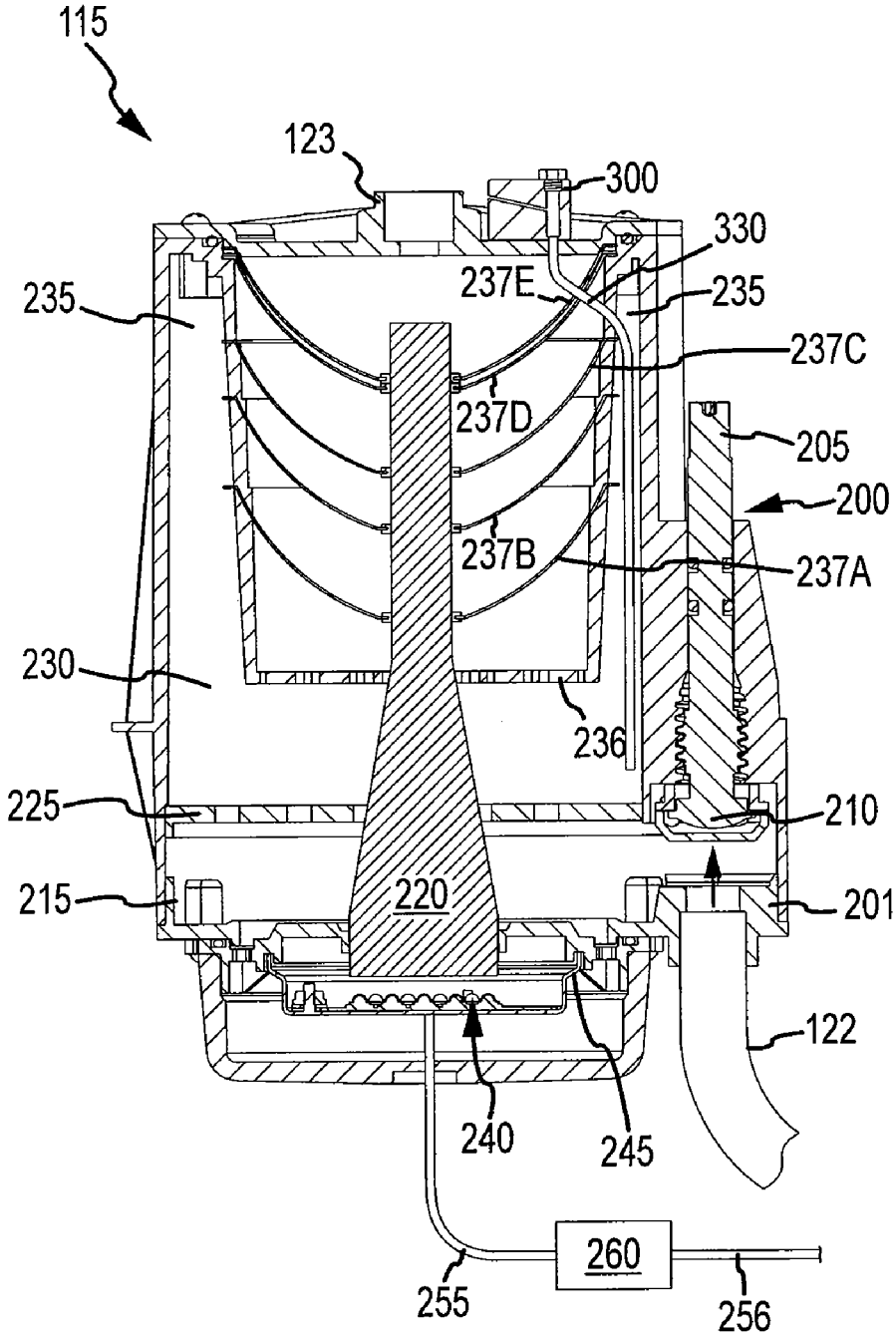
FIG. 3E illustrates one embodiment for supplying the surface disruptor with water.
Figure 3F:
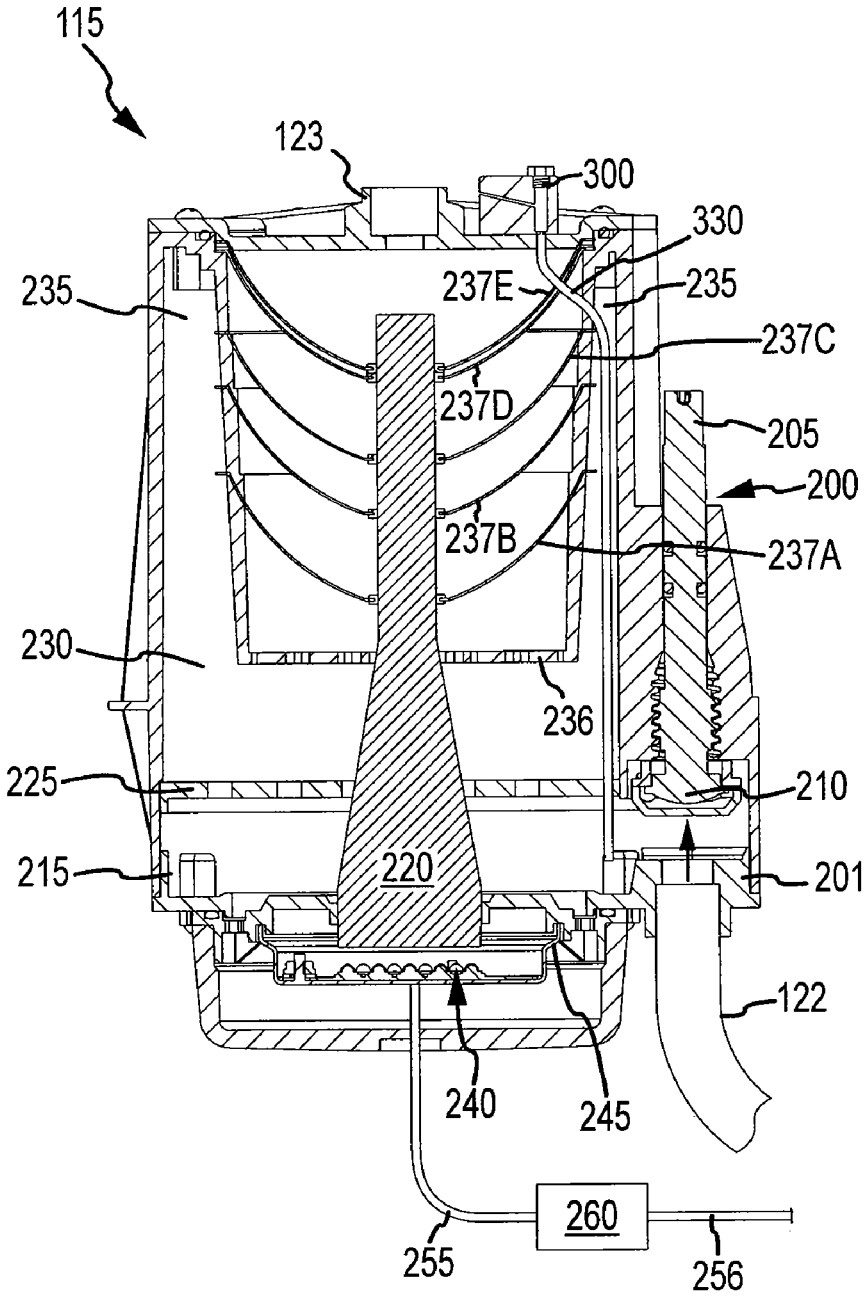
FIG. 3F illustrates yet another embodiment for supplying the surface disrupter with water.
Figure 3G:
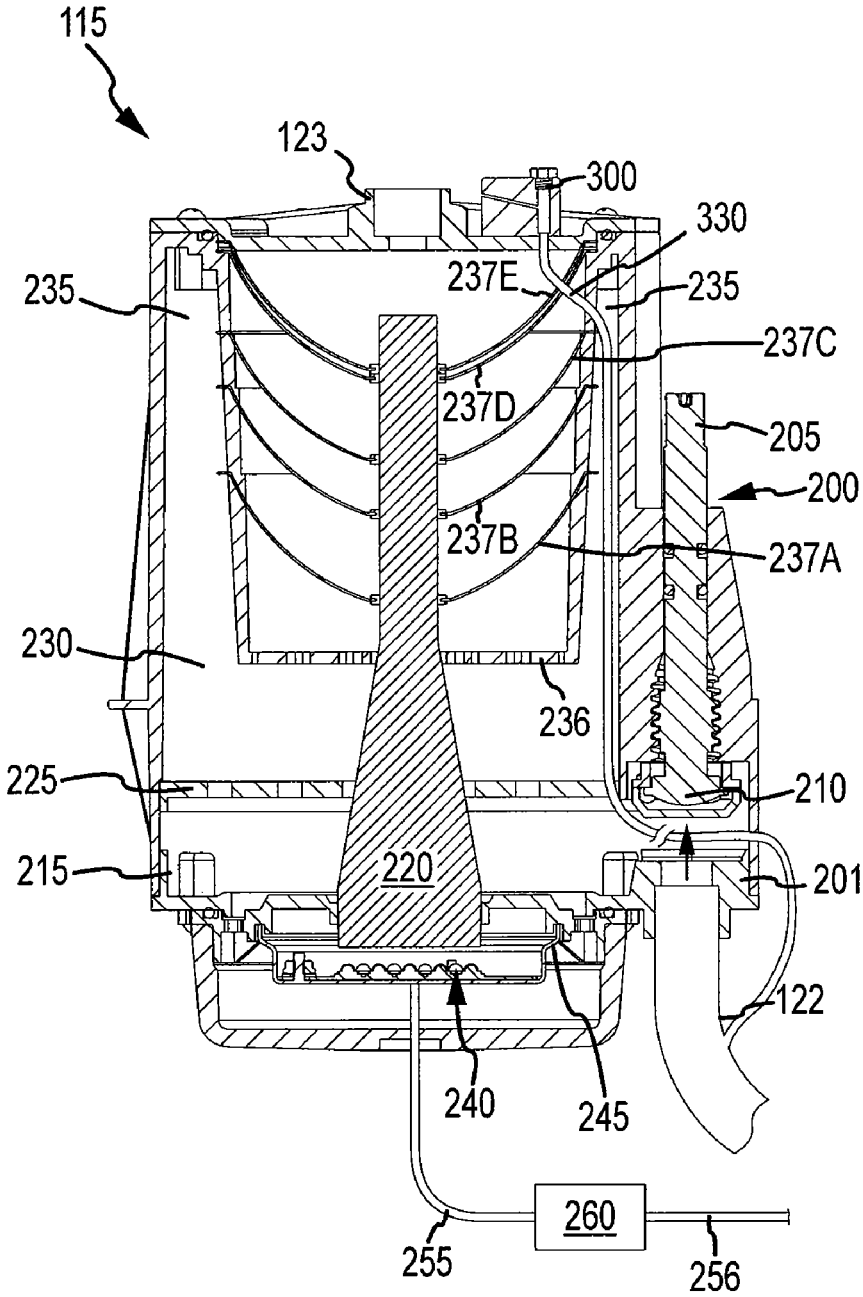
FIG. 3G illustrates still another embodiment for supplying the surface disrupter with water.

Although FIGS. 1D, 2A, and 3A-B illustrate an embodiment where the surface disrupter 300 draws water from the top of the laminar jet 115, water may be drawn from other locations. As described above, the water in the top of the laminar jet 115 may be substantially laminar. By drawing water from other locations, the laminarity of the stream 315 may be varied, and as a result, the affect on the laminar flow 320 may vary. For example, water drawn from the receiving chamber 215 via a tube 330 may be more turbulent than water drawn from the intermediate chamber 230 and drawing water from the two locations (as shown in FIGS. 3E and 3F respectively) may result in varying degrees of illumination in the laminar flow 320. Other embodiments may modify the surface of the laminar flow exiting the orifice 123 using a stream of water that is separate from the laminar jet 115. For example, FIG. 3G illustrates the situation where water from the supply line 122 may be used to disrupt the surface of the laminar flow exiting the orifice 123. Furthermore, since the water within the top of the laminar jet 115 is substantially laminar, drawing water from this chamber may impact the overall laminarity of the laminar flow 320. Thus, an additional benefit of drawing water from a location other than the top of the laminar jet 115 is that the laminarity of the water within the laminar jet 115 may be preserved.

Figure 4:
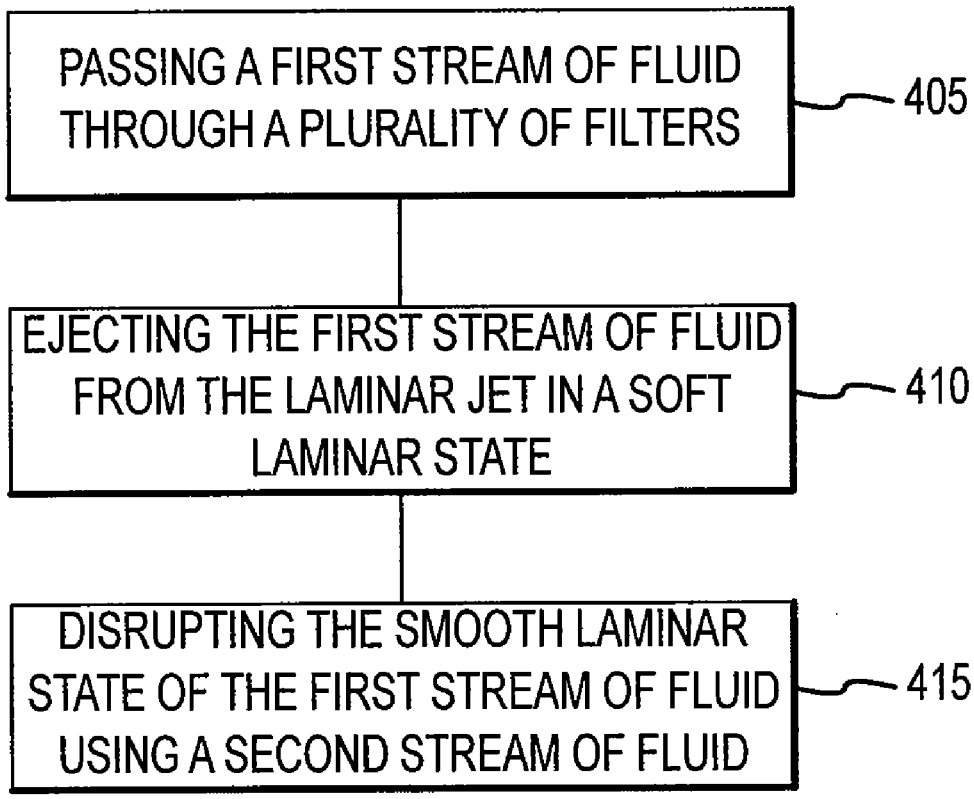
FIG. 4 illustrates exemplary operations that may be performed by the exemplary water handling device.

The laminar jet 115 may operate according to the operations shown in FIG. 4. In block 405, the laminar jet 115 may pass the stream of fluid from the supply line 122 through a series of filters 237A-E. Passing the stream of fluid through this series of filters in this manner may result in flow that is substantially laminar in nature, and this laminar flow may be ejected from the laminar jet 115 per block 410. Next, in block 415, the surface disrupter 300 may disrupt the substantially laminar flow exiting via the orifice 123. As mentioned above in the context of FIGS. 3E-3G the fluid used by the surface disrupter 300 may come a variety of locations within the laminar jet 115.

Although the present invention has been described with reference to preferred embodiments, persons skilled in the art will recognize that changes may be made in form and detail without departing from the spirit and scope of the invention. For example, while a subsurface water handling device has been discussed in detail, the principles disclosed herein may apply to water handling devices used at or above grade.

What is claimed is:

1. A fluid handling device, comprising:

a canister;

a collar coupled to the canister;

a lid coupled to the collar;

a laminar jet situated within the canister, wherein the laminar jet is suspended from the collar; and a surface disruptor wherein a flow rate of the surface disruptor is adjusted through at least one opening in the lid.

2. The fluid handling device of claim 1, wherein the canister is positioned below grade.

3. The fluid handling device of claim 1, wherein the laminar jet is suspended from the collar using at least two brackets.

4. The fluid handling device of claim 1, wherein the lid comprises at least one recess to accommodate a bracket used to suspend the laminar jet from the collar.

5. The fluid handling device of claim 1, wherein the lid includes one or more openings, and the flow rate of the laminar jet is adjusted through the one or more openings.

6. The fluid handling device of claim 1, wherein the laminar jet further comprises a light tube that couples light into a laminar stream of water exiting the laminar jet.

7. The fluid handling device of claim 6, wherein the source of light is an array of LEDs.

8. The fluid handling device of claim 7, wherein at least one LED in the array is synchronized to operations of a second fluid handling device.

9. A fluid handling device, comprising:

a canister and a laminar jet device, the laminar jet device comprising an exit orifice and a first adjustment valve;

a first stream of fluid exiting the laminar jet device through the exit orifice in a substantially laminar state; and a disruptor coupled to the laminar jet device, wherein the disruptor emits a second stream of fluid configured to intersect with the first stream, wherein the second stream modifies the substantially laminar state of the first stream, and wherein the first adjustment valve is capable of modifying a flow rate of the first stream;

a second adjustment valve, wherein the second adjustment valve is configured to modify a flow rate of the second stream; and a third adjustment valve, wherein the third adjustment valve is configured to modify a trajectory of the second stream, wherein the first adjustment valve modifies a flow rate of the second stream.

10. The fluid handling device of claim 9, wherein the first, second, and third valves are adjusted synchronously.

11. The fluid handling device of claim 10, further comprising at least one light source coupled to the first stream, and adjusting the first, second, or third valves modifies the appearance of light in the first stream.

* * * * *